US012150612B2

(12) United States Patent
Stowe et al.

(10) Patent No.: US 12,150,612 B2
(45) Date of Patent: Nov. 26, 2024

(54) DISHWASHER AND DISPENSER

(71) Applicant: WHIRLPOOL CORPORATION, Benton Harbor, MI (US)

(72) Inventors: Elliott Vernon Stowe, Stevensville, MI (US); Akshay Sanjay Tondwal, Maharashtra (IN); Phillip Daniel Swanson, Portage, MI (US); Joseph Allen Gregory, Niles, MI (US); Mario Togawa Aparicio, Nuevo Leon (MX); Richard Lee Hammond, Mattawan, MI (US); Gobi Krishnan Mallikarjunan, Saint Joseph, MI (US); Jonathan Donald Gephart, Saint Joseph, MI (US); Peter N. Howes, Chicago, IL (US); Bianca Marie Harris, South Bend, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 36 days.

(21) Appl. No.: 18/302,866

(22) Filed: Apr. 19, 2023

(65) Prior Publication Data

US 2023/0355074 A1 Nov. 9, 2023

Related U.S. Application Data

(60) Provisional application No. 63/337,649, filed on May 3, 2022.

(51) Int. Cl.
*A47L 15/44* (2006.01)
*A47L 15/00* (2006.01)

(52) U.S. Cl.
CPC ..... *A47L 15/4436* (2013.01); *A47L 15/0021* (2013.01); *A47L 15/4409* (2013.01)

(58) Field of Classification Search
CPC ..... A47L 15/00–508; D06F 1/00–95/008
See application file for complete search history.

(56) References Cited

U.S. PATENT DOCUMENTS

| | | | | |
|---|---|---|---|---|
| 4,974,750 | A | 12/1990 | Welch | |
| 8,484,999 | B2 | 7/2013 | Classen et al. | |
| 10,988,886 | B2 | 4/2021 | Jiang et al. | |
| 2014/0060121 | A1* | 3/2014 | Burger | D06F 58/203 68/17 R |
| 2014/0352744 | A1 | 12/2014 | Shintani et al. | |

FOREIGN PATENT DOCUMENTS

| | | | |
|---|---|---|---|
| DE | 102010003768 | A | 10/2011 |
| DE | 102010003776 | A1 | 10/2011 |
| DE | 112018007960 | T5 | 6/2021 |

* cited by examiner

*Primary Examiner* — Mikhail Kornakov
*Assistant Examiner* — Richard Z. Zhang
(74) *Attorney, Agent, or Firm* — McGarry Bair PC

(57) ABSTRACT

A dishwasher includes a tub at least partially defining a treating chamber with an open face. A cover is movable between an opened and a closed condition to selectively open and close the open face, respectively. The cover has an inner surface confronting the open face in the closed condition. A treating chemistry dispenser is carried by the cover and includes a housing defining a cartridge chamber with a cartridge opening and a lid assembly selectively opening and closing the cartridge opening.

19 Claims, 12 Drawing Sheets

DISHWASHER AND DISPENSER

CROSS-REFERENCE TO RELATED APPLICATION(S)

This application claims the benefit of U.S. Provisional Patent Application No. 63/337,649, filed May 3, 2022, which is incorporated herein by reference in its entirety.

BACKGROUND

Contemporary automatic dishwashers for use in a typical household include a tub and at least one rack or basket for supporting soiled dishes within the tub, and a door closing the tub. At least an upper rack and a lower rack for holding dishes to be cleaned are typically provided within the treating chamber. A basket for holding utensils, silverware, etc. is also usually provided and normally removably mounts to the door or within the lower rack.

A chemistry dispensing system can be provided for adding cleaning agents to the tub for removing soils from the dishes. The dispensing system can include various compartments to hold the chemistries. The chemistries can be liquid or solid. Actuators controlled by a controller can inject or release the chemistries into the tub during a cycle of operation.

BRIEF DESCRIPTION

An aspect of the present disclosure relates to a dishwasher comprising a tub at least partially defining a treating chamber with an open face, a cover movable between an opened and a closed condition to selectively open and close the open face, respectively, with the cover having an inner surface confronting the open face in the closed condition, and a treating chemistry dispenser carried by the cover and comprising a housing defining a cartridge chamber with a drop-in cartridge opening, a lid assembly movable between at least an opened and closed position to selectively open and close the drop-in cartridge opening, a cartridge motor assembly having a pump motor operably coupled to the cartridge chamber and movable relative to the cartridge chamber between an engaged position and a disengaged position, and an actuator operably coupling the lid assembly to the cartridge motor assembly such that the pump motor is moved between the disengaged and the engaged positions upon operation of the actuator.

DETAILED DESCRIPTION

Figure 1:
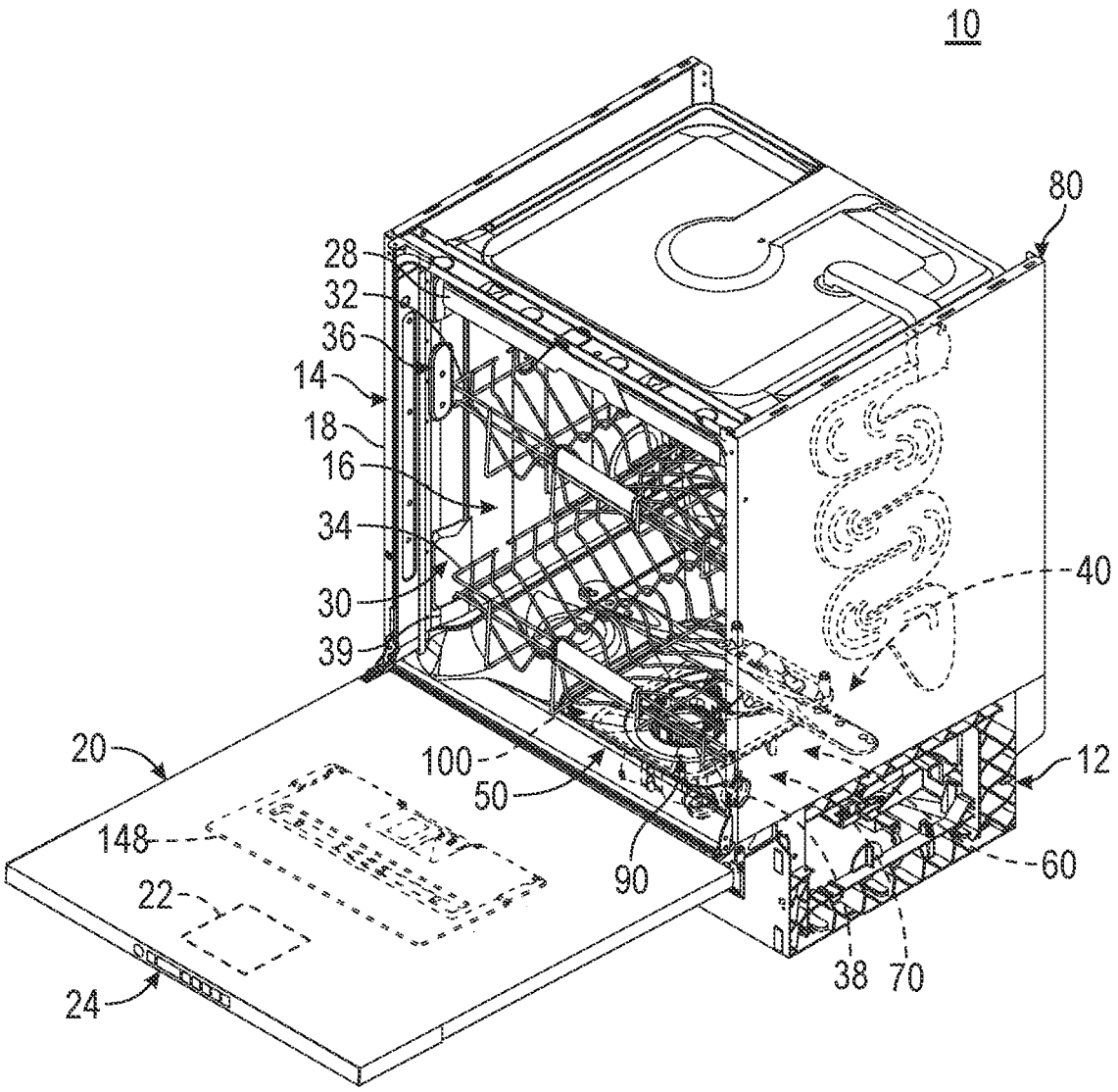
FIG. 1 is a right-side perspective view of an automatic dishwasher having multiple systems for implementing an automatic cycle of operation and including a treating chemistry dispenser.

FIG. 1 illustrates an automatic dishwasher 10 capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, and silverware. As illustrated, the dishwasher 10 is a built-in dishwasher implementation, which is designed for mounting under a countertop. However, this description is applicable to other dishwasher implementations such as a stand-alone, drawer-type or a sink-type, for example.

The dishwasher 10 has a variety of systems, some of which are controllable, to implement the automatic cycle of operation. A chassis is provided to support the variety of systems needed to implement the automatic cycle of operation. As illustrated, for a built-in implementation, the chassis includes a frame in the form of a base 12 on which is supported a open-faced tub 14, which at least partially defines a treating chamber 16, having an open face 18, for receiving the dishes. A closure or cover in the form of a door assembly 20 is pivotally mounted to the base 12 for movement between opened and closed positions to selectively open and close the open face 18 of the tub 14. Thus, the door assembly 20 provides selective accessibility to the treating chamber 16 for the loading and unloading of dishes or other items.

The chassis, as in the case of the built-in dishwasher implementation, can be formed by other parts of the dishwasher 10, like the tub 14 and the door assembly 20, in addition to a dedicated frame structure, like the base 12, with them all collectively forming a uni-body frame to which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include a dish holding system 30, a spray system 40, a recirculation system 50, a drain system 60, a water supply system 70, a drying system 80, a heating system 90, and a filter system 100. These systems are used to implement one or more treating cycles of operation for the dishes, for which there are many, and one of which includes a traditional automatic wash cycle.

A basic traditional automatic wash cycle of operation has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The wash phases and rinse phases can include the heating of the water, even to the point of one or more of the phases being hot enough for long enough to sanitize the dishes. A drying phase can follow the rinse phase(s). The drying phase can include a drip dry, heated dry, condensing dry, air dry or any combination.

A controller 22 can also be included in the dishwasher 10 and operably couples with and controls the various components of the dishwasher 10 to implement the cycle of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can include operational controls such as dials, lights, switches, and displays enabling a user to input commands, such as a cycle of operation, to the controller 22 and receive information.

The dish holding system 30 can include any suitable structure for holding dishes within the treating chamber 16. Exemplary dish holders are illustrated in the form of an upper dish rack 32 and lower dish rack 34, commonly referred to as "racks", which are located within the treating chamber 16. The upper dish rack 32 and the lower dish rack 34 are typically mounted for slidable movement in and out of the treating chamber 16 through the open face 18 for ease of loading and unloading. Drawer guides/slides/rails 36 are typically used to slidably mount the upper dish rack 32 to the tub 14. The lower dish rack 34 typically has wheels or rollers 38 that roll along rails 39 formed in sidewalls of the tub 14 and onto the door assembly 20, when the door assembly 20 is in the opened position.

Dedicated dish holders can also be provided. One such dedicated dish holder is a third level rack 28 located above the upper dish rack 32. Like the upper dish rack 32, the third level rack 28 is slidably mounted to the tub 14 with drawer guides/slides/rails 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack 28, it can be washed in the third level rack 28. The third level rack 28 generally has a much shorter height or lower profile than the upper and lower dish racks 32, 34. Typically, the height of the third level rack 28 is short enough that a typical glass cannot be stood vertically in the third level rack 28 and the third level rack 28 still slide into the treating chamber 16.

Another dedicated dish holder can be a silverware basket (not shown), which is typically carried by one of the upper or lower dish racks 32, 34 or mounted to the door assembly 20. The silverware basket typically holds utensils and the like in an upright orientation as compared to the on-the-side or flat orientation of the third level rack 28.

A treating chemistry dispenser 148 is provided to dispense treating chemistry, e.g. detergent, anti-spotting agent, etc., into the treating chamber 16. The treating chemistry dispenser 148 can be mounted on an inner surface of the door assembly 20, as shown, or can be located at other positions within the chassis. The treating chemistry dispenser 148 can dispense one or more types of treating chemistries. The treating chemistry dispenser 148 can be a single-use dispenser or a bulk dispenser, or a combination of both.

Figure 2:
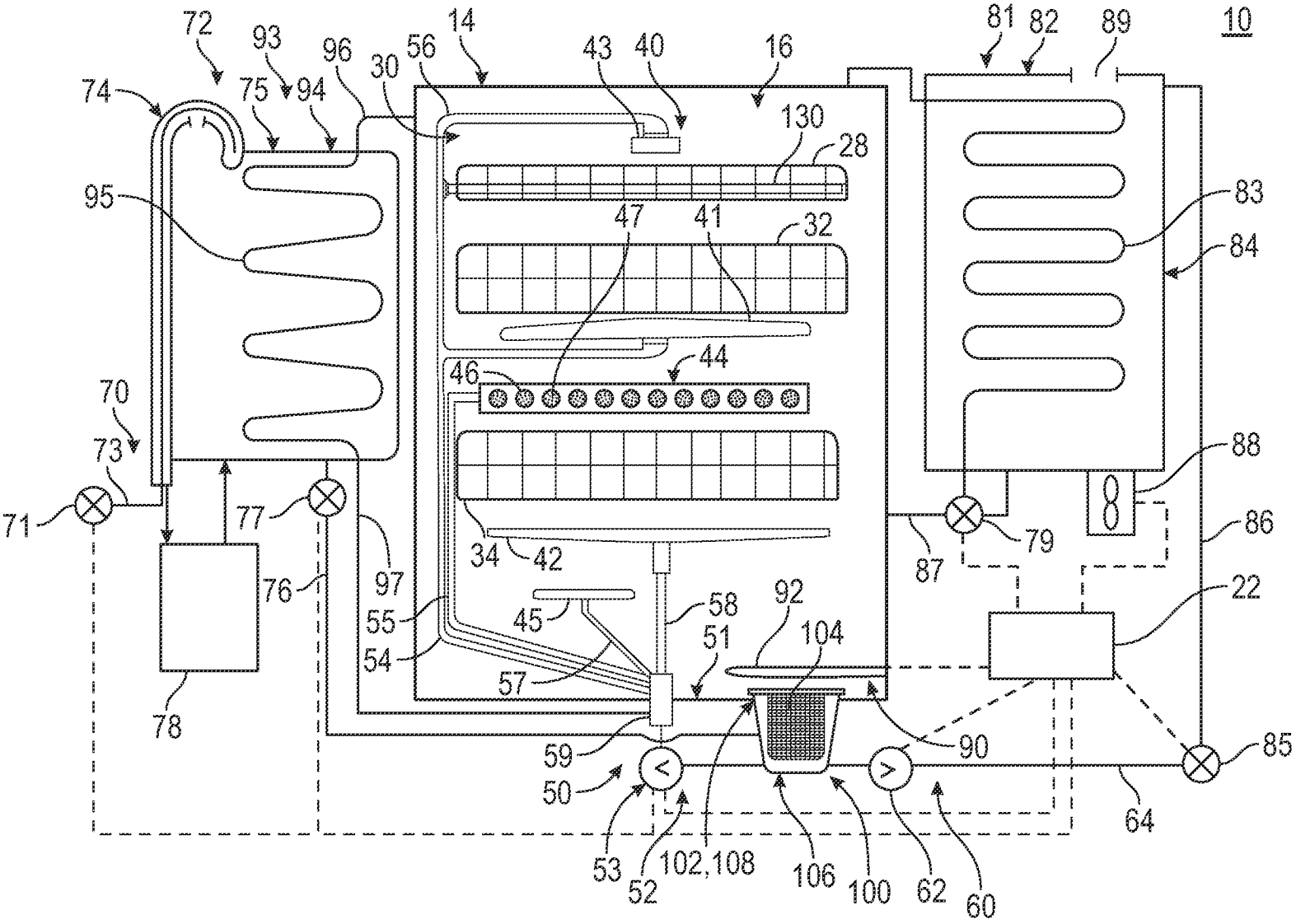
FIG. 2 is a schematic view of the dishwasher of FIG. 1 and illustrating at least some of the plumbing and electrical connections between at least some of the systems.

Turning to FIG. 2, the spray system 40 is provided for spraying liquid in the treating chamber 16 and can have multiple spray assemblies or sprayers, some of which can be dedicated to a particular one of the dish racks 28, 32, 34, to a particular area of a dish rack 28, 32, 34, to a particular type of cleaning, or to a particular level of cleaning, etc. The sprayers can be fixed or movable, such as rotating, relative to the treating chamber 16 or dish racks 28, 32, 34. Six exemplary sprayers are illustrated and include an upper spray arm 41, a lower spray arm 42, a third level sprayer 43, a deep-clean sprayer 44, and a spot sprayer 45. The upper spray arm 41 and lower spray arm 42 are rotating spray arms, located below the upper dish rack 32 and lower dish rack 34, respectively, and rotate about a generally centrally located and vertical axis. The third level sprayer 43 is located above the third level rack 28. The third level sprayer 43 is illustrated as being fixed, but could move, such as in rotating. In addition to the third level sprayer 43, or in place of the third level sprayer 43, a sprayer 130 can be located at least in part below a portion of the third level rack 28. The sprayer 130 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or move, such as in rotating. The spray emitted by the deep-clean sprayer 44 defines a deep clean zone, which, as illustrated, would extend along a rear side of the lower dish rack 34. Thus, dishes needing deep cleaning, such as dishes with baked-on food, can be located in the lower dish rack 34 to face the deep-clean sprayer 44. The deep-clean sprayer 44, while illustrated as only one unit on a rear wall of the tub 14 could comprise multiple units and/or extend along multiple portions, including different walls, of the tub 14, and can be provided above, below or beside any of the dish racks 28, 32, 34 where deep-cleaning is desired.

The spot sprayer 45, like the deep-clean sprayer 44, can emit an intensified and/or higher pressure spray, especially to a discrete location within one of the dish racks 28, 32, 34. While the spot sprayer 45 is shown below the lower dish rack 34, it could be adjacent any part of any dish rack 28, 32, 34 or along any wall of the tub 14 where special cleaning is desired. In the illustrated location below the lower dish rack 34, the spot sprayer 45 can be used independently of or in combination with the lower spray arm 42. The spot sprayer 45 can be fixed or can move, such as in rotating.

These six sprayers 41, 42, 43, 44, 45, 130 are illustrative examples of suitable sprayers and are not meant to be limiting as to the type of suitable sprayers.

The recirculation system 50 recirculates the liquid sprayed into the treating chamber 16 by the sprayers 41, 42, 43, 44, 45, 130 of the spray system 40 back to the sprayers 41, 42, 43, 44, 45, 130 to form a recirculation loop or circuit by which liquid can be repeatedly and/or continuously sprayed onto dishes in the dish racks 28, 32, 34. The recirculation system 50 can include a sump 51 and a pump assembly 52. The sump 51 collects the liquid sprayed in the treating chamber 16 and can be formed by a sloped or recess portion of a bottom wall of the tub 14. The pump assembly 52 can include one or more pumps such as a recirculation pump 53. The sump 51 can also be a separate module that is affixed to the bottom wall and includes the pump assembly 52.

Multiple supply conduits 54, 55, 56, 57, 58 fluidly couple the sprayers 41, 42, 43, 44, 45, 130 to the recirculation pump 53. A recirculation valve 59 can selectively fluidly couple each of the conduits 54-58 to the recirculation pump 53. While each sprayer 41, 42, 43, 44, 45, 130 is illustrated as having a corresponding dedicated supply conduit 54-58, one or more subsets, comprising multiple sprayers from the total group of sprayers 41, 42, 43, 44, 45, 130, can be supplied by the same conduit, negating the need for a dedicated conduit 54-58 for each sprayer 41, 42, 43, 44, 45, 130. For example, a single conduit can supply the upper spray arm 41 and the third level sprayer 43. Another example is that the sprayer 130 is supplied liquid by the conduit 56, which also supplies the third level sprayer 43.

The recirculation valve 59, while illustrated as a single valve, can be implemented with multiple valves. Additionally, one or more of the conduits 54-58 can be directly coupled to the recirculation pump 53, while one or more of the other conduits 54-58 can be selectively coupled to the recirculation pump 53 with one or more valves. There are essentially an unlimited number of plumbing schemes to connect the recirculation system 50 to the spray system 40. The illustrated plumbing is not limiting.

The drain system 60 drains liquid from the treating chamber 16. The drain system 60 includes a drain pump 62 fluidly coupling the treating chamber 16 to a drain line 64. As illustrated, the drain pump 62 fluidly couples the sump 51 to the drain line 64.

While separate recirculation and drain pumps 53 and 62 are illustrated, a single pump can be used to perform both the recirculating and the draining functions. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to some extent.

The water supply system 70 is provided for supplying fresh water to the dishwasher 10 from a household water supply via a household water valve 71. The water supply system 70 includes a water supply unit 72 having a water supply conduit 73 with a siphon break 74. While the water supply conduit 73 can be directly fluidly coupled to the tub 14 or any other portion of the dishwasher 10, the water supply conduit 73 is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 is provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

The drying system 80 is provided to aid in the drying of the dishes during the drying phase. The drying system 80 as illustrated includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber 16, or a combination of both by operating in one configuration and then the other configuration.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60 or water supply system 70 such that liquid can be supplied to the cooling tank 84. The liquid provided to the cooling tank 84 from any of the systems 40, 50, 60, 70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected on the site-specific environmental conditions. If ambient air is cooler than the cold water temperature, then the ambient air can be used. If the cold water is cooler than the ambient air, then the cold water can be used. Cost-effectiveness can also be taken into account when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

The heating system 90 is provided for heating water used in the cycle of operation. The heating system 90 includes a heater 92, such as an immersion heater 92, located in the treating chamber 16 at a location where it will be immersed by the water supplied to the treating chamber 16. The heater 92 need not be an immersion heater 92, it can also be an in-line heater located in any of the conduits. There can also be more than one heater 92, including both an immersion heater 92 and an in-line heater.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

The filter system 100 is provided to filter un-dissolved solids from the liquid in the treating chamber 16. The filter system 100 includes a coarse filter 102 and a fine filter 104, which can be a removable basket 106 residing in the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated such as an ultrafiltration system.

Figure 3:
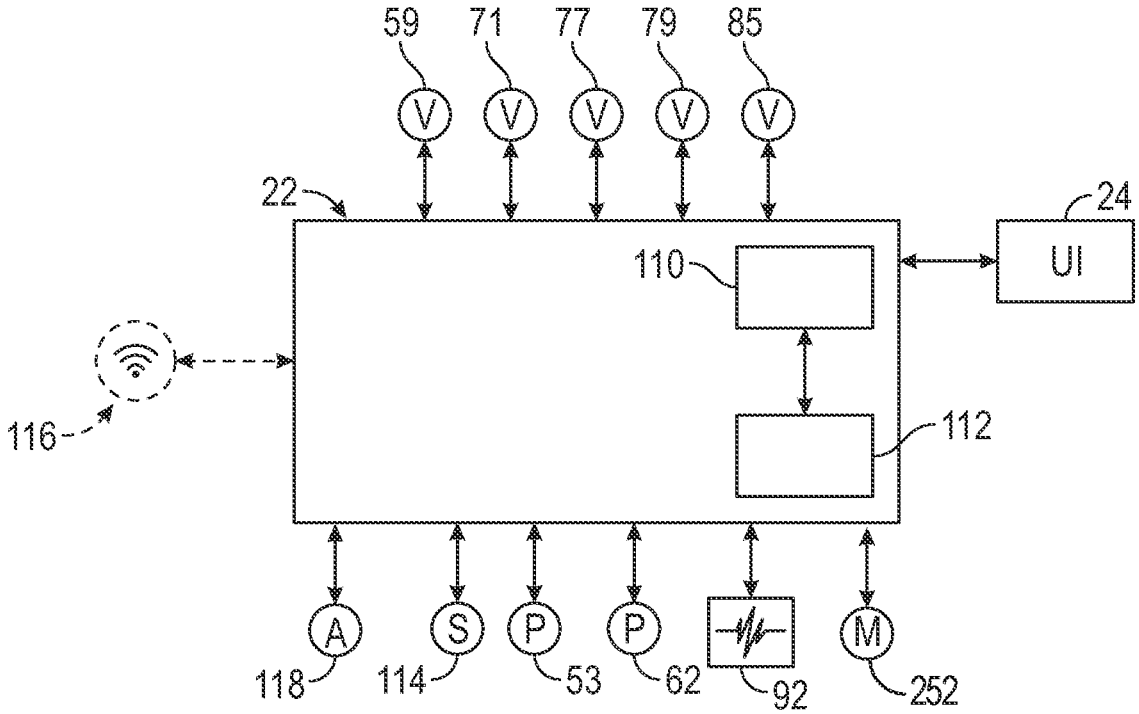
FIG. 3 is a schematic view of a controller of the dishwasher of FIGS. 1 and 2.

As illustrated schematically in FIG. 3, the controller 22 can be coupled with the heater 92 for heating the wash liquid during a cycle of operation, the drain pump 62 for draining liquid from the treating chamber 16, and the recirculation pump 53 for recirculating the wash liquid during the cycle of operation. The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store one or more pre-programmed automatic cycles of operation that can be selected by a user and executed by the dishwasher 10. The controller 22 can also receive input from one or more sensors 114. Non-limiting examples of sensors 114 that can be communicably coupled with the controller 22 include, to name a few, an ambient air temperature sensor, a treating chamber temperature sensor, a water supply temperature sensor, a door open/close sensor, and a turbidity sensor to determine the soil load associated with a selected grouping of dishes, such as the dishes associated with a particular area of the treating chamber 16. The controller 22 can also communicate with the recirculation valve 59, the household water valve 71, the controllable valve 77, the return valve 79, and the valve 85. Optionally, the controller 22 can include or communicate with a wireless communication device 116. The controller 22 can include or communicate with an antenna 118 for transmitting and receiving information. The controller 22 can be coupled with a set of pump motors 252 for dosing the chemistries from the treating chemistry dispenser 148.

Figure 4:
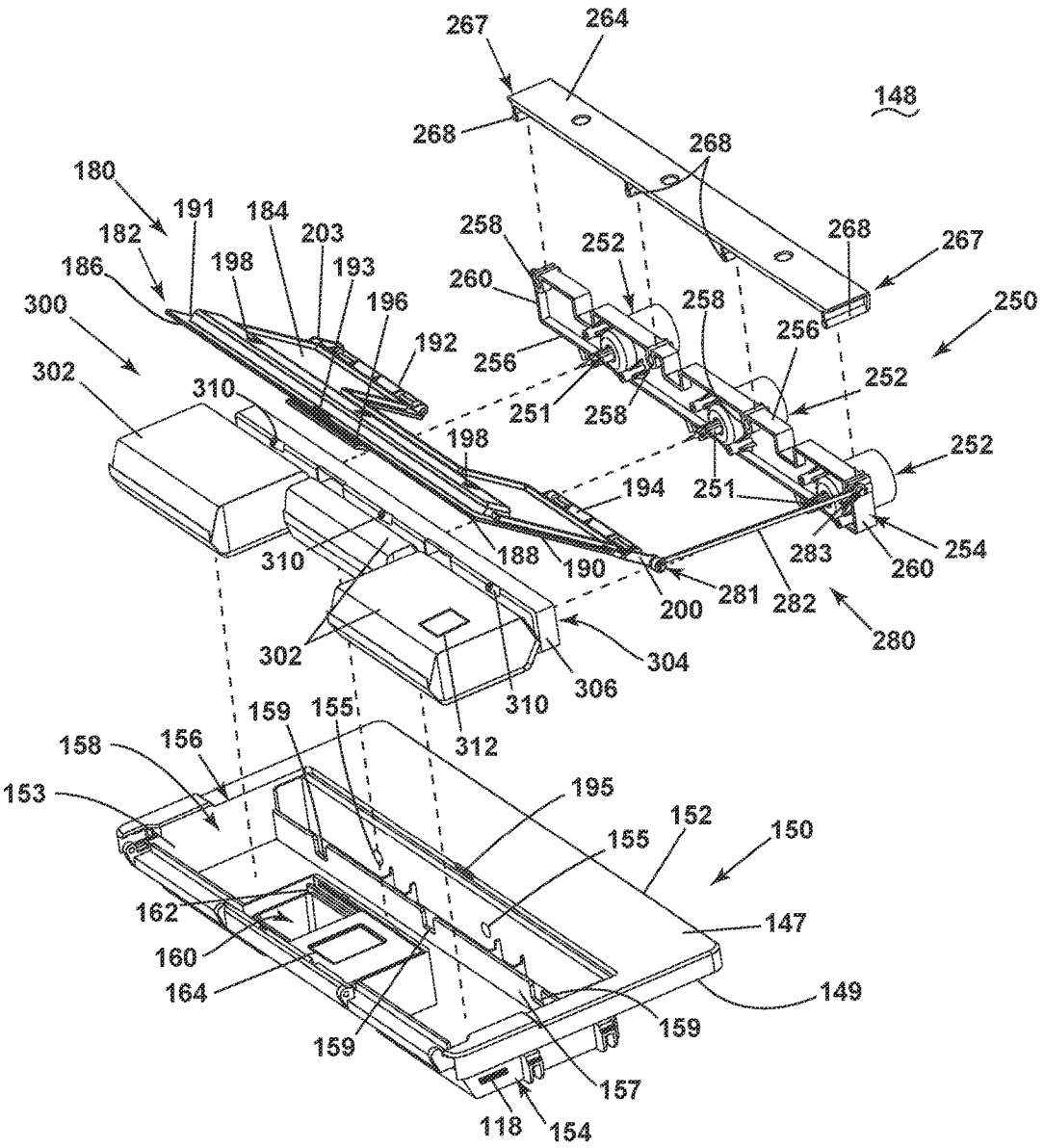
FIG. 4 is a partially exploded perspective view of the treating chemistry dispenser of FIG. 1 and illustrating a housing, with a drop-in opening, selectively closed by a lid coupled to an actuator, and a treating chemistry cartridge adapted to be received within the housing, according to aspects disclosed herein.

Referring to FIG. 4, according to an aspect disclosed herein, the treating chemistry dispenser 148 can include a housing 150. The housing 150 can have a frame 152 that extends around at least a portion of the periphery of the housing 150 and defines an outer side 147 of the frame 152 that is accessible by the user and an inner side 149 of the frame 152. The housing 150 includes a recessed compartment 154. The recessed compartment 154 is bounded by a sidewall 153. The sidewall 153 can be provided with holes 155. At least a portion of the recessed compartment 154 can be accessed by a drop-in cartridge opening, illustrated herein as a drop-in opening 156. The drop-in opening 156 defines a plane, which is coplanar with the inner surface of the door assembly 20. The recessed compartment 154 can include at least one partition 157 extending across the recessed compartment 154. In one non-limiting example, the at least one partition 157 includes notches 159. A cartridge chamber 158 can be included in the recessed compartment 154.

In addition to the cartridge chamber 158, the housing 150 can optionally include a closeable tablet compartment 160 positioned adjacent the recessed compartment 154. In one non-limiting example, the housing 150 can include a set of rails 162 adjacent the tablet compartment 160. A closure 164 can be provided that slides along the rails 162 to cover or expose the tablet compartment 160. It is contemplated that other mechanisms for closing the tablet compartment 160 can be implemented within the scope of the disclosure, such as a spring mechanism or a hinge and latch, along with a pivoting or hinged closing as compared to sliding. In one non-limiting example, the closure 164 can be manually closed by the user and activated by the controller 22 to open during a cycle of operation to release a cleaning agent contained within the tablet compartment 160 into the tub 14.

The treating chemistry dispenser 148 can include a closure, one example of which is a lid assembly 180. The lid assembly 180 includes a lid 182. The lid 182 can have at least a first inner side 184 and a second outer side 186. The lid 182 can include at least a top edge 188, a first side edge 190, a second side edge 191, and a bottom edge 192. The lid 182 can be pivotably attached to the housing 150, for example, by a hinge 194. The hinge 194 can be located along the bottom edge 192. The lid 182 can rotate about the hinge 194 between an opened position and a closed position.

The second outer side 186 of the lid 182 can have a handle 196 positioned near the top edge 188 for the user to grasp in order to move the lid 182. A series of nozzle openings 198 extend through the lid 182 from the first inner side 184 to the second outer side 186. A latch 193 can be provided at the top edge 188. In one non-limiting example, the latch 193 can be a flexible tab. The housing 150 includes a receiver 195 positioned to correspond to the latch 193 when the lid 182 is in the closed position. It is contemplated that any reasonable quick-release mechanism can be used for latch 193 and receiver 195.

The treating chemistry dispenser 148 can include a cartridge motor assembly 250. The set of pump motors 252 are included in the cartridge motor assembly 250. The cartridge motor assembly 250 includes a motor frame 254. The set of pump motors 252 is supported by the motor frame 254. Each pump motor 252 of the set of pump motors 252 is spaced from each other along the motor frame 254. A motor coupler 251 of each pump motor 252 of the set of pump motors 252 extends through openings in the motor frame 254. The motor frame 254 can include at least two long edges 256. One of the long edges 256 can have a set of C-shaped indentations 258. The motor frame 254 can include at least two parallel short edges 260. The set of C-shaped indentations 258 is spaced such that at least one C-shaped indentation 258 of the set of C-shaped indentations 258 is immediately adjacent one of the short edges 260.

The cartridge motor assembly 250 includes a slide support 264. The slide support 264 can include a set of guide bars 268 projecting from one side of the slide support 264. In one non-limiting example, the set of guide bars 268 can be spaced from one another such that at least one guide bar 268 of the set of guide bars 268 is located near a terminal edge 267 of the slide support 264. The slide support 264 abuts the underside or inner side 149 of the frame 152 and can be fixed to the housing 150 by fasteners (not shown).

An actuator 280 connects the lid assembly 180 to the cartridge motor assembly 250. In one non-limiting example, the actuator 280 can be a pivot assembly connecting the lid 182 to the motor frame 254. The actuator 280 can include at least a first pivot joint 281, a second pivot joint 283, and a linkage or a set of links 282 in the form of a rigid bar or rod. In the example illustrated, the set of links 282 has one link 282 and connects to the first and second pivot joints 281, 283. It is contemplated that the set of links 282 can include multiple links 282 with corresponding first and second pivot joints 281, 283, such as two links and three pivot joints.

A first side arm 200 can extend away from the lid 182 along at least a portion of the first side edge 190 near the bottom edge 192. The first side arm 200 extends beyond the hinge 194. The first side arm 200 supports the first pivot joint 281. The set of links 282 can be pivotably attached to the first side arm 200 of the lid 182 at the first pivot joint 281. A second side arm 203 having the same or similar structure to the first side arm 200 can be included on the lid 182. In one non-limiting example, the second side arm 203 can extend along the second side edge 191 and support another pivot joint.

The motor frame 254 can include the second pivot joint 283. The second pivot joint 283 can be located at one of the short edges 260. The second pivot joint 283 connects the set of links 282 to the motor frame 254. In one non-limiting example, the lid 182 can have the first and second side arms 200, 203, positioned on the first side edge 190 and on the second side edge 191, respectively, such that each short edge 260 of the motor frame 254 can be linked to the lid 182 by the actuator 280 on both ends. It should be appreciated that the lid 182 and the motor frame 254 can include any reasonable pivot joint component that is complementary to the pivot joint component of the set of links 282.

A cartridge 300 for use in the treating chemistry dispenser 148 is also shown in FIG. 4. It is contemplated that the cartridge 300 is a consumable product and can be disposed of, recycled, or returned for exchange. The cartridge 300 can include a set of containers 302 for holding treating chemistries. According to an aspect of the disclosure herein, the containers 302 can be separate from one another. In another non-limiting example, the containers 302 can be connected on an exterior surface for structural support. The containers 302 can have different volumes. Non-limiting examples of treating chemistries that can be included in the cartridge 300 and the containers 302 include detergents, rinse aid, disinfecting agents, enzyme solutions, and the like. In the example illustrated in FIG. 4, the set of containers 302 includes three containers 302, however it should be appreciated that the set of containers 302 can include any number of containers 302 including one container 302. The set of containers 302 can be made of any suitable materials that are flexible, collapsible, rigid, or non-collapsible, soft, hard, or combinations thereof. Collapsible containers 302, as illustrated, are, in some ways, simpler than non-collapsible in that the collapsible containers 302 do not require a vent to prevent a low pressure forming in the container 302 that would prevent or interfere with removal of the contents.

The cartridge 300 can be provided with a set of cartridge pumps 304 corresponding to the set of containers 302. The set of cartridge pumps 304 is enclosed within a pump casing 306. The cartridge 300 includes at least one cartridge pump 304 of the set of cartridge pumps 304 per container 302. In one non-limiting example, the set of cartridge pumps 304 are peristaltic pumps. The set of cartridge pumps 304 includes a set of nozzles 310. Each nozzle 310 of the set of nozzles 310 protrudes out of the pump casing 306.

An information tag 312 can be included with the cartridge 300. Examples of information tags 312 include, but are not limited to, bar codes, radio frequency identification (RFID) tags, near field communication (NFC) tags, and magnetic strips. Data on the information tag 312 can be read by the controller 22. Additional data can be written to the information tag 312 by the controller 22. As shown, the information tag 312 can be fixed to one of the containers 302, however it should be appreciated that the information tag 312 may be fixed at other locations on the cartridge 300. The information tag 312 can be a device integrated with the cartridge 300 that can be coupled, either by a hardwire connection or wireless connection, to the dishwasher 10 for communication with the dishwasher 10. The information tag 312 can be coupled to the controller 22 via the wireless communication device 116. For example, another external communicating device, such as the antenna 118, can be used to couple the information tag 312 to the controller 22. For data transfer, the antenna 118 can be positioned within the door assembly 20 in a location within less than 5 mm of the information tag 312 when the cartridge 300 is in the cartridge chamber 158. In other non-limiting examples, the antenna 118 can be positioned between 5 mm and 10 mm from the information tag 312, or between 10 mm and 100 mm from the information tag 312.

Examples of data retained by the information tag 312 include, but are not limited to, authentication information, confirmation of cartridge 300 origin, number of containers 302, general identity of the contents of each container 302, specific formulation information of the contents of each container 302, available volume of treatment chemistries in each container 302, number of available doses of treatment chemistry in each container 302, soil sensor data at the time of dosing, date/time of the last dose delivered from the cartridge 300, age of cartridge 300, projected expiration date of cartridge 300, projected replacement date of cartridge 300, cycle parameters such as the time in the cycle of the dosing, the temperature at the time of dosing, and dosing levels set manually by the user.

The controller 22 can write information to the information tag 312, such as information associated with the contents of the cartridge 300. For example, after a cycle or phase is completed, the remaining quantity of treatment chemistry can be updated by writing the new data to the information tag 312. The quantity of treatment chemistry remaining in each of the containers 302 is updated and written to the information tag 312 such that the remaining doses can be accurately calculated. In one non-limiting example, the information tag 312 includes the number of doses available, and after one cycle using one dose of chemistry, the number of doses available recorded on the information tag 312 is updated by reducing the number of doses available by one. The number of doses used per cycle need not be limited to integral numbers. For example, a sensor reading during a cycle can cause additional or partial doses of treatment chemistries to be used. In one non-limiting example, a sensor (not shown), such as a turbidity sensor, detects a high level of soil and determines an amount of treatment chemistry is needed that is in excess of a normal dose. The controller 22 directs the new amount of chemistry to be added from the cartridge 300. Additionally, a correspondingly higher amount of the other treatment chemistries in the cartridge 300 are also dispensed. The new updated number of doses available can be calculated and written to the information tag 312 by the controller 22.

The data stored on the information tag 312 is retained even if the cartridge 300 is removed from the appliance. In one non-limiting example, a user can remove the cartridge 300 for storage. Additionally, and alternatively, a user can remove the cartridge 300 for use in another dishwasher 10, such as a separate dishwasher or a drawer dishwasher. When the cartridge 300 is inserted, the number of treatment chemistry doses available in the cartridge 300 stored on the information tag 312 can be read by the controller 22.

Figure 5:
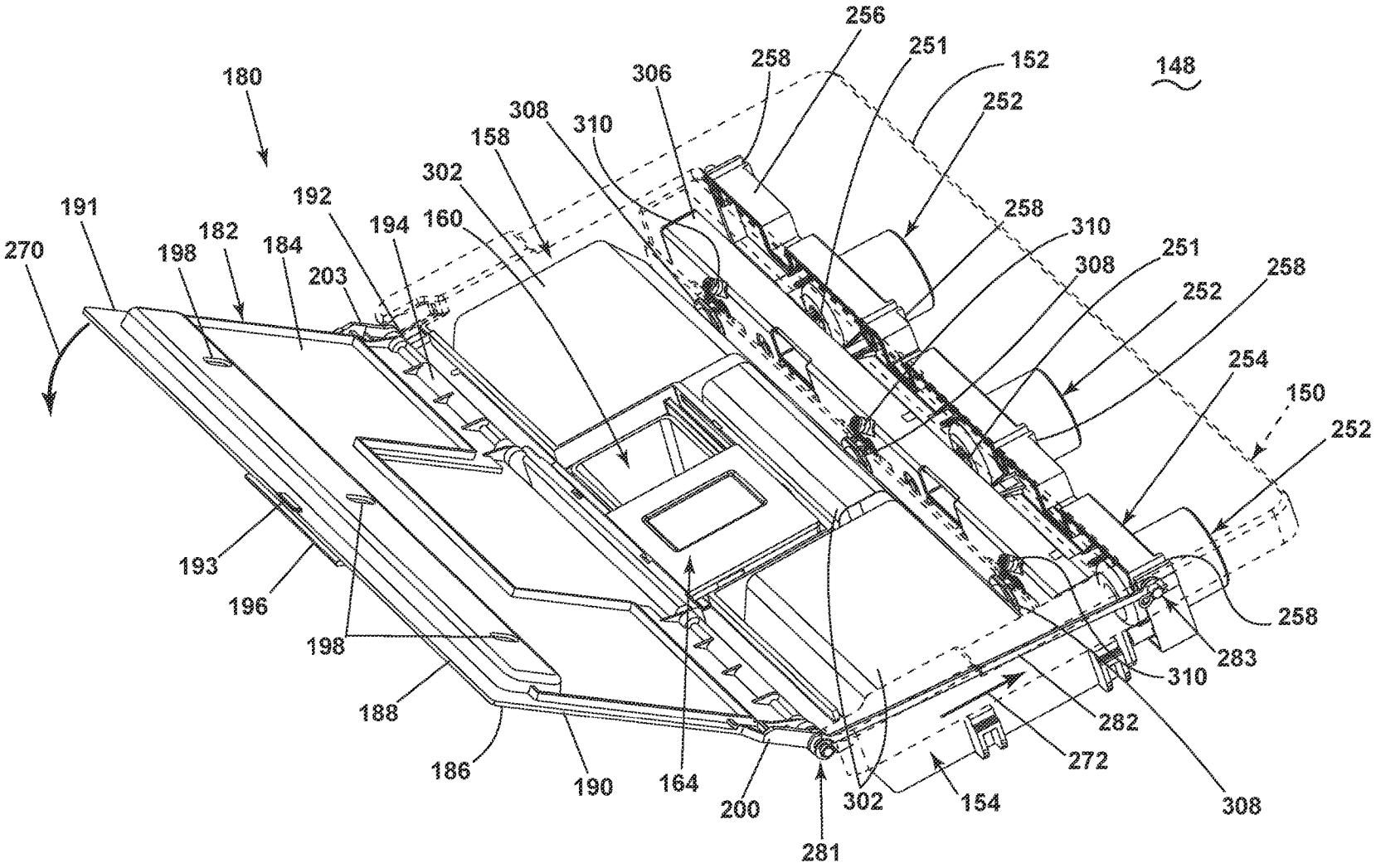
FIG. 5 is a perspective view of the treating chemistry dispenser of FIG. 4 assembled and loaded with the treating chemistry cartridge, where the lid of the treating chemistry dispenser is in a partially opened position.

Turning now to FIG. 5, the assembled treating chemistry dispenser 148 is shown with the cartridge 300 inside the housing 150 prior to the closing of the lid 182. The slide support 264 has been left out for clarity and the frame 152 is shown as transparent (dotted line). The motor frame 254 can extend along the exterior of the recessed compartment 154 underneath the frame 152. The cartridge motor assembly 250 can be located behind a portion of the frame 152 that extends away from the recessed compartment 154. The motor coupler 251 of each of the pump motors 252 of the set of pump motors 252 extends through the sidewall 153 (FIG. 4), such as through the holes 155 (FIG. 4). The cartridge 300 can be arranged in the cartridge chamber 158 such that the containers 302 are on one side of the partition 157 (FIG. 4) and the pump casing 306 is on the other side. Each cartridge pump 304 (FIG. 4) of the set of cartridge pumps 304 is fluidly connected to one of the set of containers 302 by a coupling 308. Each of the couplings 308 rests on the partition 157 (FIG. 4), for example in one of the notches 159 (FIG. 4). The lid 182 can be pivoted from a closed to an open position as indicated by arrow 270. The lid 182 is connected to the pivot assembly or actuator 280 (FIG. 4) including the first side arm 200, first and second pivot joints 281, 283, and links 282, such that moving the lid 182 in the direction of arrow 270 causes the motor frame 254 to move away from the lid 182, in the direction indicated by arrow 272.

Figure 6:
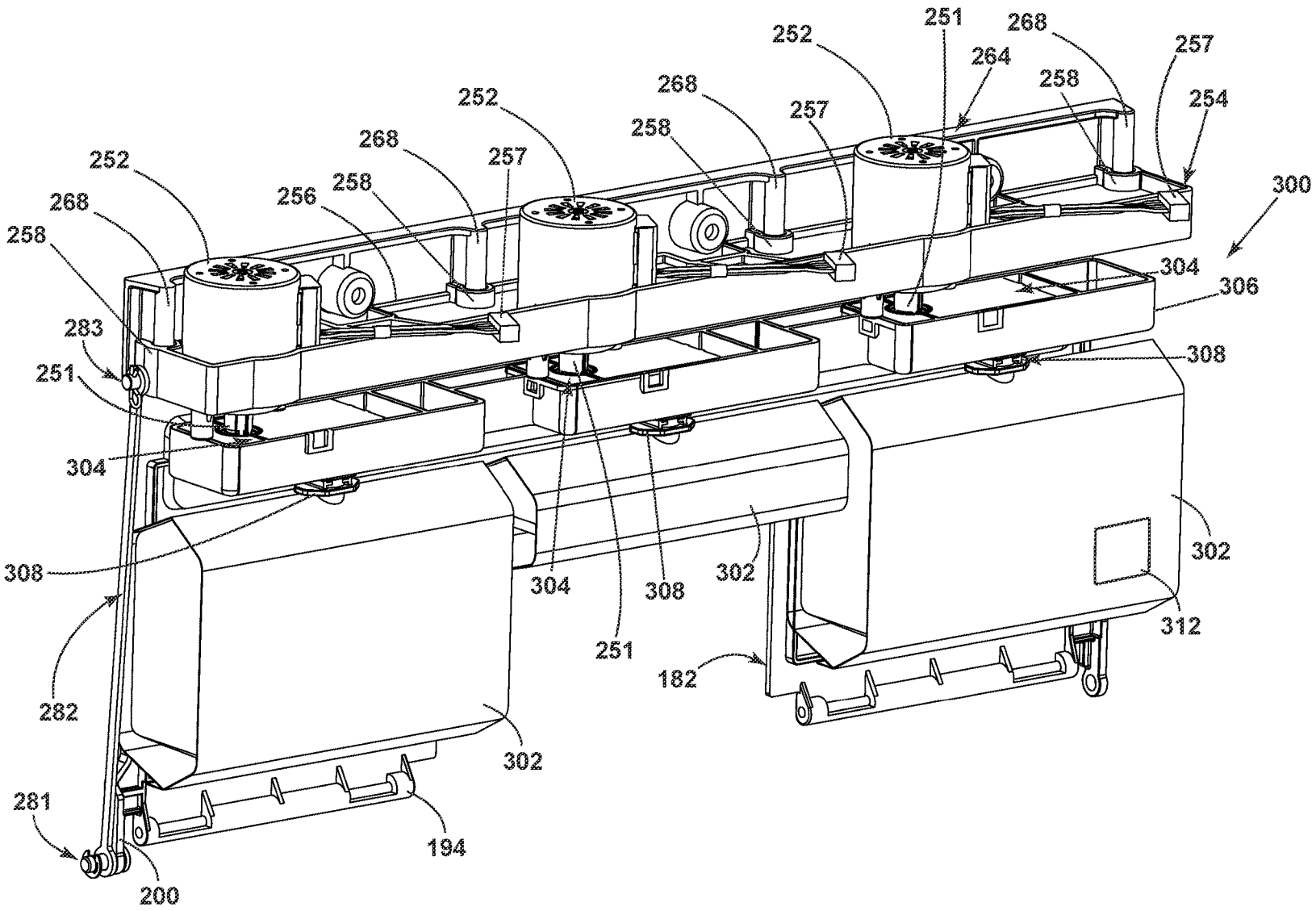
FIG. 6 is a rear perspective view of a portion of the treating chemistry dispenser of FIG. 4, illustrating the lid and the treating chemistry cartridge, where the lid is in a closed position, and with the housing removed.

The cartridge motor assembly 250 with the cartridge 300 can be viewed in more detail in FIG. 6, with the housing 150 and the frame 152 removed. In the assembled configuration, the slide support 264 extends along one of the long edges 256 of the motor frame 254. The set of C-shaped indentations 258 of the motor frame 254 slidably engage with the guide bars 268 of the slide support 264. The slide support 264 is fixed to the inner side 149 of the frame 152 (FIG. 4). A set of electrical connectors 257 is provided, with one of the electrical connectors 257 corresponding to each pump motor 252 of the set of pump motors 252 for communication with the controller 22. The motor couplers 251 extend into the pump casing 306 to engage the cartridge pumps 304. As shown, the lid 182 is in the closed position. The cartridge motor assembly 250 is engaged with the cartridge 300. In this position, each cartridge pump 304 of the set of cartridge pumps 304 is coupled to one pump motor 252 of the set of pump motors 252. In other words, the set of pump motors 252 is in an engaged position. When the lid 182 is in the opened position, or partially opened position, as shown in FIG. 5, the set of pump motors 252 is pulled away from the cartridge pumps 304 and is in a disengaged position.

Figure 7:
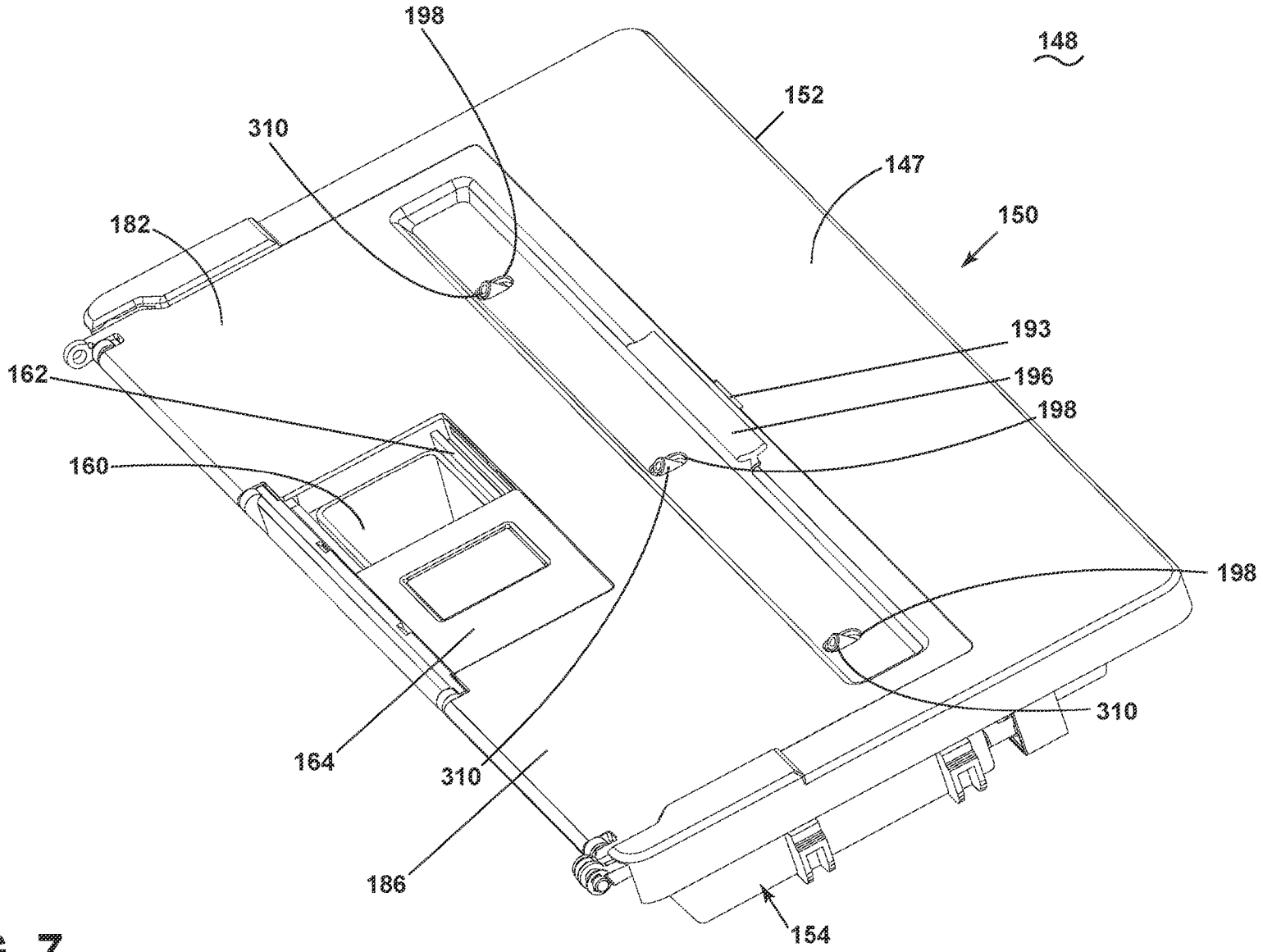
FIG. 7 is a front perspective view of the treating chemistry dispenser of FIG. 4, where the lid is in the closed position.

FIG. 7 shows the treating chemistry dispenser 148 as the user would see it when the lid 182 is in the closed position. The lid 182 can cover the cartridge 300 except for the nozzles 310, which emerge through the nozzle openings 198. The frame 152 conceals the cartridge motor assembly 250 and actuator 280. The tablet compartment 160 can be left uncovered by the lid 182. The tablet compartment 160 is accessible such that a tablet, gel, liquid or other treatment chemistry can be added to the tablet compartment 160 which can then be closed by sliding the closure 164 along rails 162, or by any other reasonable means. The latch 193 and receiver 195 (FIG. 4) can engage to secure the lid 182 to the housing 150 in the closed position. In the closed position, the lid 182 prevents water and food soil ingress to the cartridge chamber 158 and supports the mass of the cartridge 300 when the dishwasher 10 door assembly 20 is closed.

Figure 8:
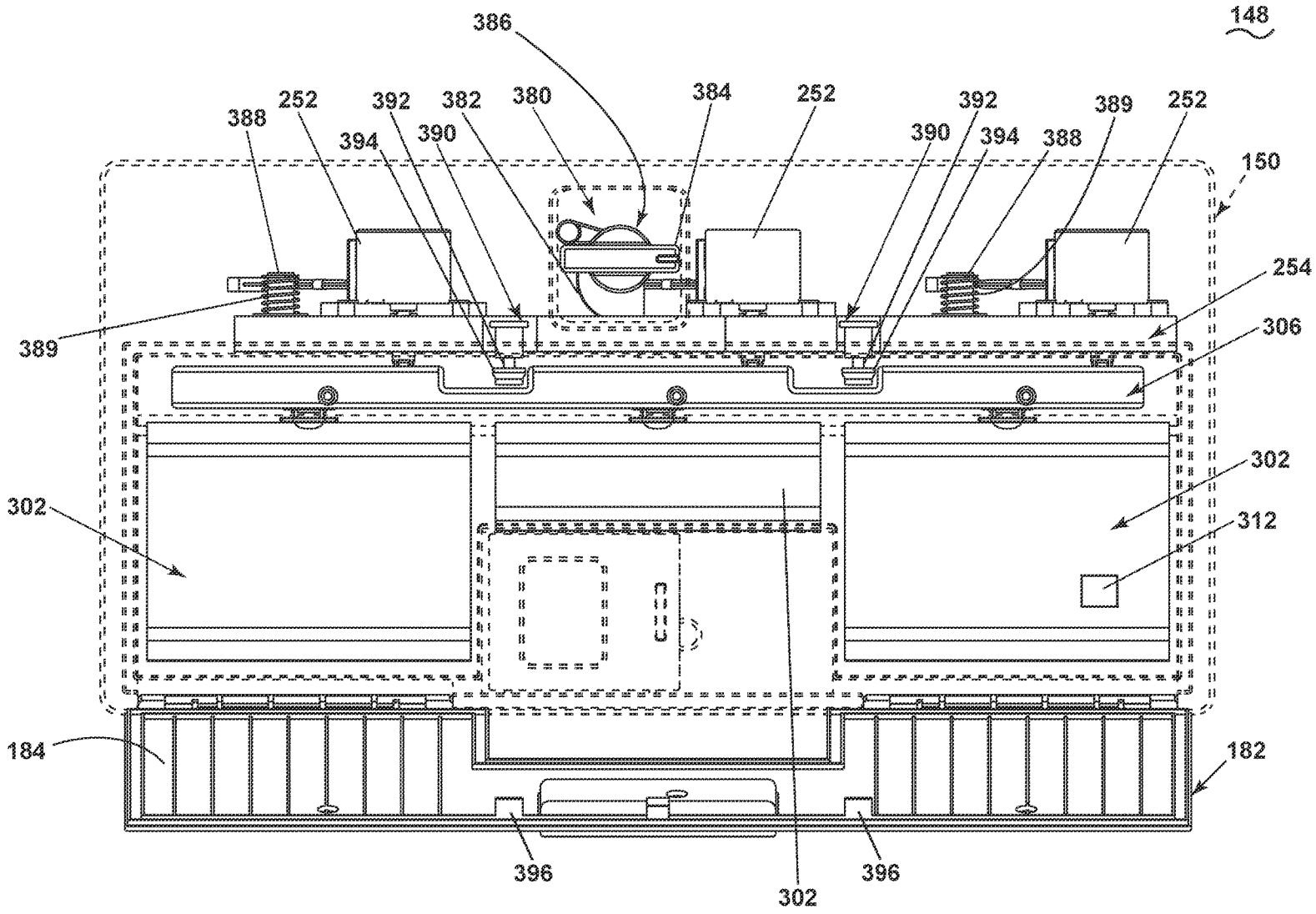
FIG. 8 is a front view of the treating chemistry dispenser of FIG. 4 including another example of an actuator that can be used within the treating chemistry dispenser of FIG. 4, according to another aspect disclosed herein, with the housing shown as transparent for clarity, the lid shown in the partially opened position, and the actuator including a lock.
Figure 9:
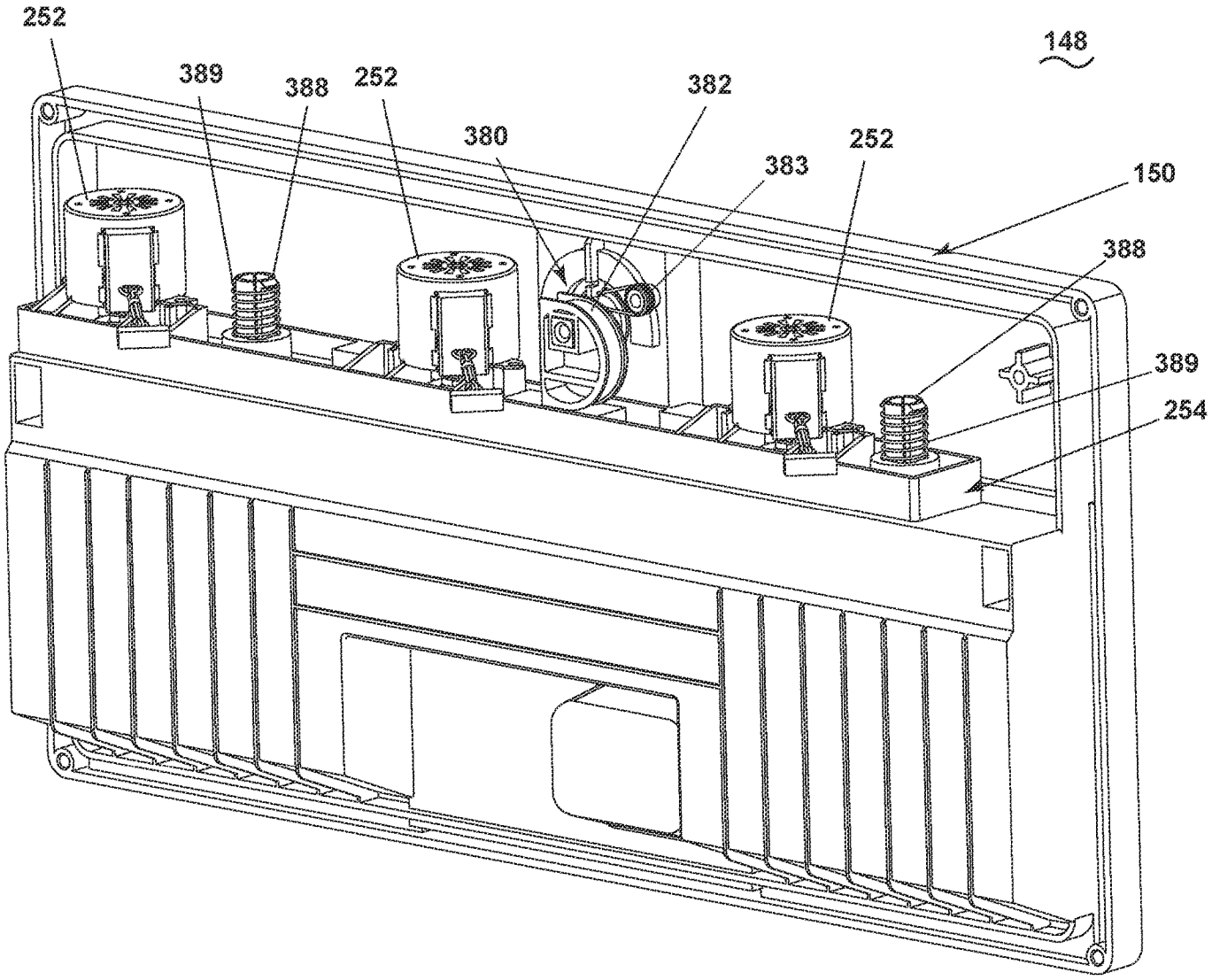
FIG. 9 is a rear perspective view of the treating chemistry dispenser of FIG. 8 where the actuator is in a locked position and the lid is shown in the closed position.

As used herein and turning now to FIG. 8, another non-limiting example of an actuator 380 is presented that can be used in the treating chemistry dispenser 148 in place of the actuator 280. According to an aspect of the disclosure, as shown in FIGS. 8 and 9, the actuator 380 can be an over-center cam 382 connected to a lever 384. The over-center cam 382 can have a semi-circle or lobe shape, or any other suitable shape for translating a rotational motion to a linear movement. The over-center cam 382 can be attached to a rotatable knob 386 positioned at the second outer side 186 of the lid 182 when the lid 182 is in the closed position, where the knob 386 includes the lever 384. The knob 386 and the over-center cam 382 can be rotated between a locked position, as shown, and an unlocked position (not shown), wherein the over-center cam 382, the lever 384, and the knob 386 are rotated relative to the housing 150. The locked and unlocked positions can be marked with indicia (not shown) on the frame 152.

The over-center cam 382 can be positioned on the inner side 149 (FIG. 4) of the frame 152 adjacent and selectively contacting the motor frame 254. The lever 384 is positioned on the outer side 147 (FIG. 4) of the frame 152, such that it is accessible and can be rotated by the user. In one non-limiting example, the knob 386 can be rotated 180 degrees counter-clockwise by the user from the locked position, as shown, to the unlocked position, which in turn rotates the lever 384 and the over-center cam 382 by 180 degrees counter-clockwise. The profile of the over-center cam 382 is flat on both ends, as can be better seen in the view of FIG. 9, so that the over-center cam 382 will be held in place at either end of the 180-degree stroke. The over-center cam 382 bears directly against the motor frame 254 in the locked position, as shown. The rotation of the over-center cam 382 is thus operably coupled to the motor frame 254, such that rotation of the over-center cam 382 linearly moves the motor frame 254 between the engaged position, as shown, and the disengaged position (FIG. 5). The distance the motor frame 254 and set of pump motors 252 move linearly between the disengaged position (FIG. 5) and the engaged position as shown can be about 15 mm. Additionally, and alternatively, the distance the motor frame 254 and set of pump motors 252 move between engaged, as shown, and disengaged (FIG. 5) positions can be between 5 and 20 mm.

The over-center cam 382 can include a return spring 383 that biases the over-center cam 382 to the opened or unlocked position (not shown), where the over-center cam 382 is rotated 180 degrees counter-clockwise and does not bear directly against the motor frame 254. This would ensure the over-center cam 382 is in the open position (not shown) when unlocked to avoid jamming the lid 182. By way of non-limiting example, when the over-center cam 382 is rotated 180 degrees counter-clockwise to the unlocked position, the over-center cam 382 can bear against the periphery of the frame 152, such that the over-center cam 382 is held in place in the unlocked position.

As the knob 386 is moved clockwise from the unlocked position (not shown) to the locked position of FIGS. 8-9, the over-center cam 382 is moved into contact with and to bear against the motor frame 254, such that the motor frame 254 and the set of pump motors 252 is moved from the disengaged (FIG. 5) to the engaged position as shown, and also as illustrated in FIG. 6. A set of posts 388 act as a linear guide for the motor frame 254 such that the entire motor frame 254 moves linearly between the disengaged (FIG. 5) to the engaged positions, as shown. The set of posts 388 can include a bias 389, for example a spring, such that the motor frame 254 is biased for movement from the engaged position, as shown, to the disengaged position (FIG. 5) when the actuator 280 is in the unlocked position and does not bear against the motor frame 254 to hold the motor frame 254 in the engaged position, as it does in the locked position.

The motor frame 254 can carry at least one lock 390. The at least one lock 390 can be moveable between a locked position, as shown, and an unlocked position (not shown) by the action of the over-center cam 382 along with the motor frame 254. In one non-limiting example, the lock 390 can have a shaft 392 and a base 394, where the width of the shaft 392 is smaller than that of the base 394. The at least one lock 390 is fixed in the motor frame 254 such that the shaft 392 and base 394 extend out of the motor frame 254. The lid 182 includes at least one standoff 396 extending out from the first inner side 184 of the lid 182. The at least one standoff 396 corresponds to the at least one lock 390. When the lid 182 is in the closed position of FIG. 9 and the at least one lock 390 is in the locked position, the at least one standoff 396 fits and can be retained between the shaft 392 and the base 394 to lock the lid 182 relative to the housing 150. When the lever 384 and the over-center cam 382 are in the unlocked position (not shown), or in any intermediate position between the locked and unlocked positions, the motor frame 254 is in the disengaged position (FIG. 5) and carries the at least one lock 390 to the unlocked position (not shown), wherein the at least one lock 390 is linearly shifted along with the motor frame 254, such that the base 394 obstructs the standoff 396, thus preventing the lid 182 from closing. This feature gives the user confidence that the cartridge 300 and cartridge motor assembly 250 are in the correct position for operation when the lid 182 is closed.

Figure 10:
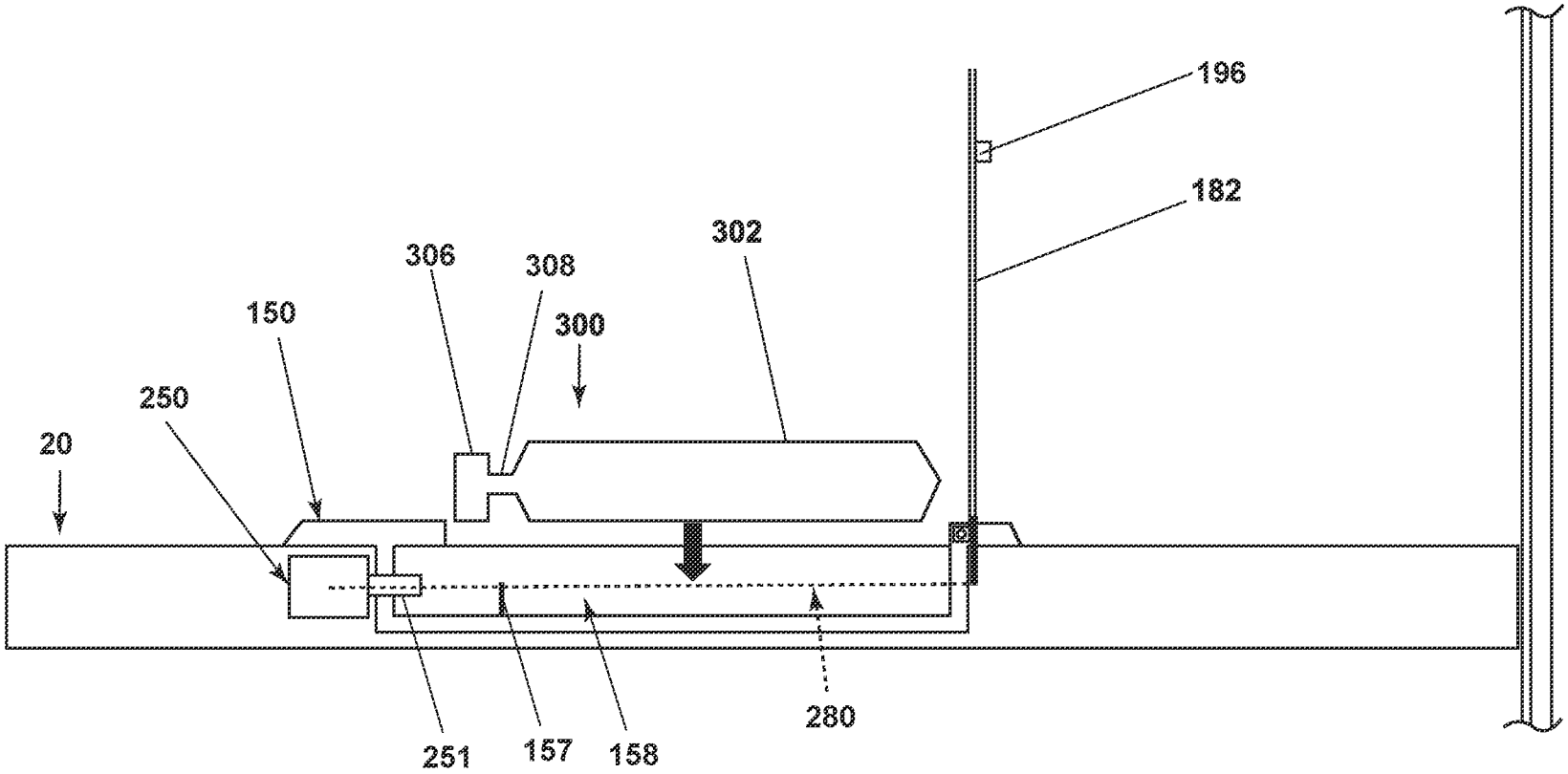
FIG. 10 is a schematic side view of the treating chemistry dispenser and actuator of FIG. 4, illustrated within a door assembly of the dishwasher of FIGS. 1-2, and shown with the lid in the partially opened position, the treating chemistry cartridge in an unloaded position, and a motor assembly in a disengaged position.
Figure 11:
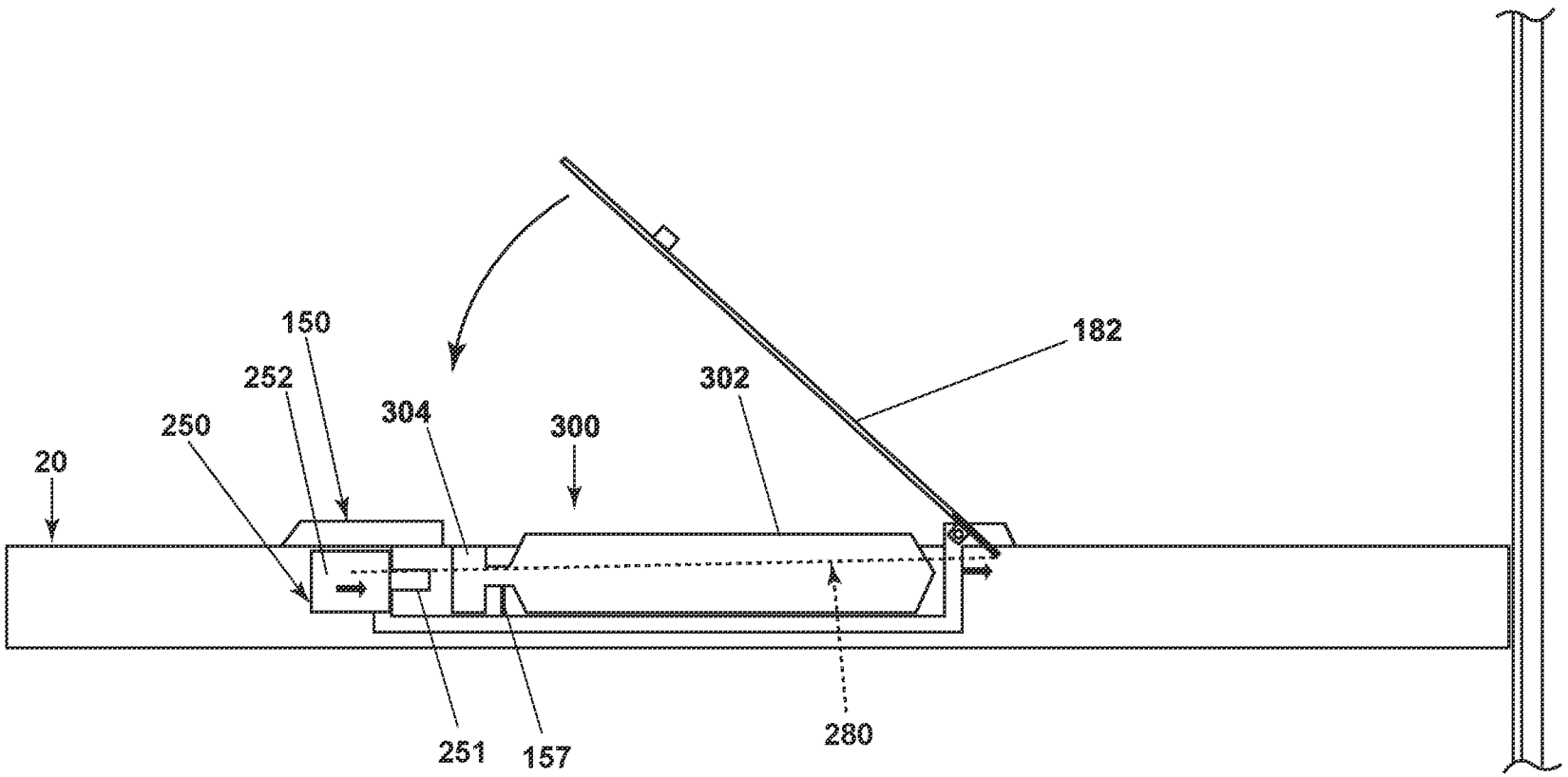
FIG. 11 is the schematic side view of the treating chemistry dispenser of FIG. 10, showing the lid in a partially closed position and the treating chemistry cartridge in an intermediate loading position.
Figure 12:
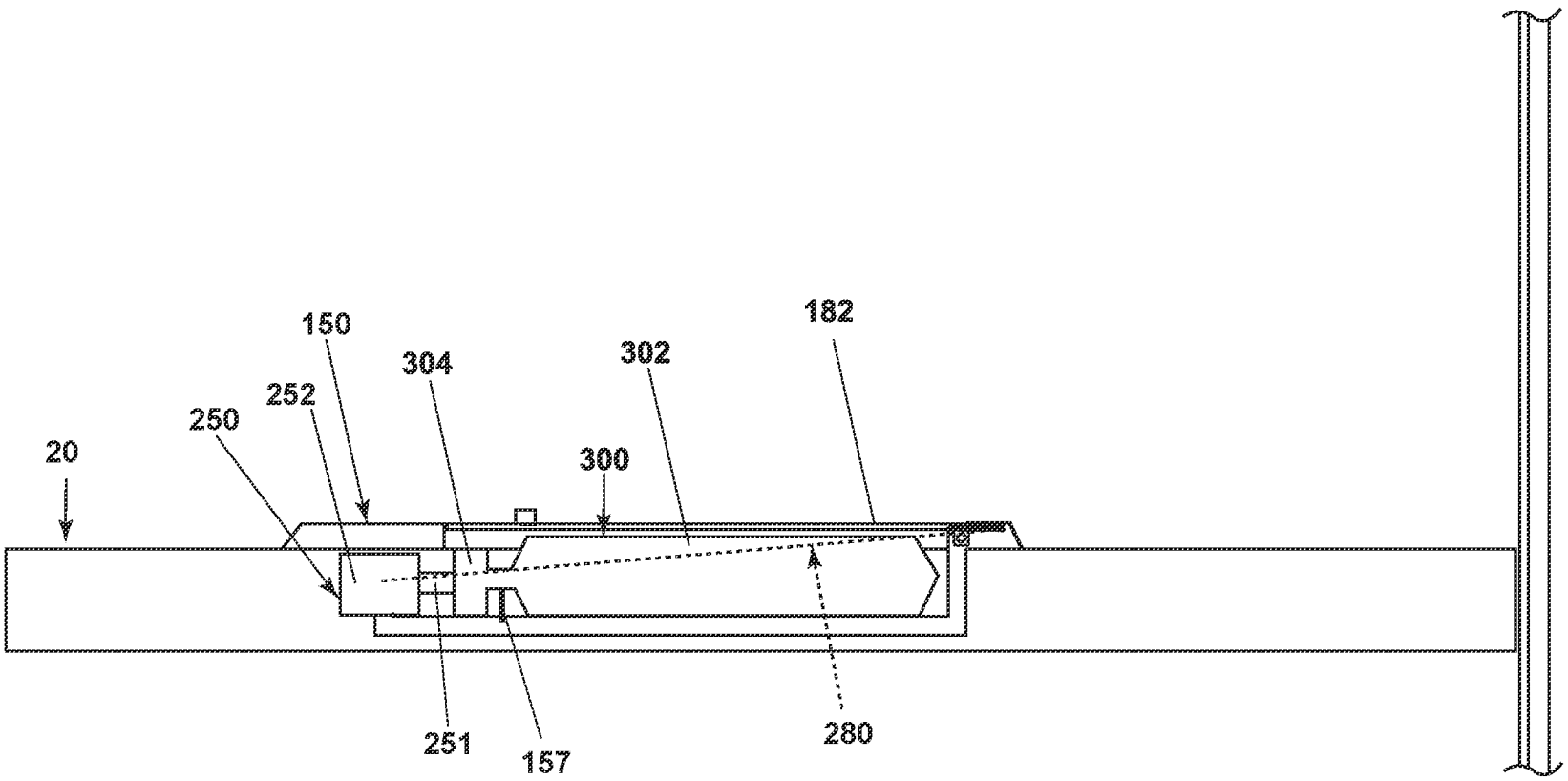
FIG. 12 is the schematic side view of the treating chemistry dispenser of FIG. 10, showing the lid in the closed position, the treating chemistry cartridge in a fully loaded position in the treating chemistry dispenser, and the motor assembly in an engaged position.

The schematic views shown in FIGS. 10-12 show how the cartridge 300 can be loaded and positioned to be used in the treating chemistry dispenser 148 having the actuator 280. In operation, when the dishwasher 10 door assembly 20 is in the opened position, and roughly parallel with the floor, a user can open the lid 182 by grasping the handle 196 and pulling to rotate the lid 182 to a partially opened position shown in FIG. 10. Rotating the lid 182 to the partially opened position causes the actuator 280 to move the cartridge motor assembly 250 to the disengaged position as shown (see also FIG. 5), such that the cartridge 300 can be loaded or unloaded. The cartridge 300 can be inserted from an unloaded position, as shown, into the treating chemistry dispenser 148 in the direction as indicated by the bold arrow. The user can place the cartridge 300 in the cartridge chamber 158 in the direction of the bold arrow or remove the cartridge 300 from the cartridge chamber 158 in the opposite direction.

Turning now to FIG. 11, the cartridge 300 can be situated by the user in an intermediate position of loading, such that the couplings 308 rest on the partition 157 and the pump casing 306 is on the side of the partition 157 opposite the containers 302. Once the cartridge 300 has been inserted into the cartridge chamber 158 to at least the intermediate position of loading, data included on the information tag 312 (FIG. 4) can be read by the controller 22. The information tag 312 can be written to, where new data is added to the information tag 312. The information contained on the information tag 312, such as authentication information, is read by the controller 22.

As the user closes the lid 182 in the direction as shown in FIG. 11, with the cartridge 300 in the intermediate loading position, the actuator 280 moves the cartridge motor assembly 250 at least partially towards the engaged position (FIG. 6, FIG. 12) where the motor coupler 251 of each pump motor 252 of the set of pump motors 252 engages one of the cartridge pumps 304 of the set of cartridge pumps 304. The partition 157 stabilizes the cartridge 300 during the insertion or removal of the motor couplers 251.

When the lid 182 is in the fully closed position as shown in FIG. 12, the cartridge motor assembly 250 is positioned in the engaged position by the actuator 280, such that each of the motor couplers 251 of each of the pump motors 252 is engaged with one of the cartridge pumps 304 of the set of cartridge pumps 304. The cartridge 300 is secured behind the lid 182 in a fully loaded position engaged with the cartridge motor assembly 250, such that the pump motors 252 are fluidly coupled with the containers 302 via the motor couplers 251 and the cartridge pumps 304, and the cartridge 300 is ready for use.

The cartridge 300 includes more than one treatment chemistry and can hold multiple doses so the user does not have to add chemistry for each cycle. When a user inserts the cartridge 300 in the treating chemistry dispenser 148, the docking of the pump motors 252 with the cartridge pumps 304 on the cartridge 300 occurs when the user closes the lid 182 or turns the knob 386 of the actuator 380, improving the user experience. The information tag 312 stores data regarding the contents of the cartridge 300 and communicates with the controller 22 about dose amounts and cycle parameters such as amounts, temperatures, and timing. The data stored on the information tag 312 can be updated to keep an accurate count of remaining doses available.

This treating chemistry dispenser and cartridge system improve cleaning performance in several ways. By moving the motor assembly to engage the cartridge, the designs disclosed herein allow the cartridge footprint to fit within the dishwasher door without taking up rack space and interfering with dish capacity. By splitting the chemistry into constituent parts and storing the chemistries in separate containers in one cartridge, each with a dedicated pump, each chemistry can be dispensed independently according to the user preference or type of load (for example, fine porcelain vs pots/pans, heavily soiled vs a few dishes, or by sensor detection of level of soil). Storing the chemistries separately allows a greater variety of chemistries to be used that would otherwise chemically interfere with one another.

The contactless or wireless communication with the information tag on the cartridge allows the machine to adapt to the chemistry added and allow future chemistries to function with the original system. The information tag helps improve cleaning performance by providing the information to the dishwasher regarding the chemistry added, allowing the chemistry dose to be adapted as needed. As the information tag can be updated by the controller, the information tag always has the correct information regarding the cartridge contents. The user experience is improved by the convenience of not having to add detergent to every cycle and the enabling of automatic start and reordering of cartridges.

Another benefit of the cartridge communication is that the information tag can be programmed to contain cycle parameters. In this situation, when the cartridge is loaded, the controller can read certain cycle parameters from the cartridge, such as preferred cycle segment times or temperatures for the best results with a particular chemistry. If cycle parameters are input by the user, the new parameters can be written to the information tag for future reference.

The dishwasher cartridge communicates with the controller to provide information on cartridge contents and quantity remaining. The controller communicates with the dishwasher user interface and the Whirlpool consumer mobile application and can recommend the consumer insert a new cartridge, order a new cartridge(s), or enable automatic ordering.

Yet another benefit of the information tag is to automatically enable use of the cartridge. If the cartridge is present and not empty, the machine can default to dispensing the treatment chemistries from the cartridge. If the cartridge is not present, the machine can default to using a traditional detergent dispenser door operation. The default settings can be enabled by a user selection on the user interface or using a mobile application.

Another benefit of the chemistry dosing system is that it can detect the dosing of chemistry. Sensing of the chemistry can be done with either pH, conductivity or other similar measurement devices. The user can be notified through a mobile app of an error with the dosing system or cartridge. The notification to the user could be to check the proper connection of the cartridge, that regular preventative maintenance is needed, or a servicer can be directly notified of the issue if service is required.

To the extent not already described, the different features and structures of the various aspects can be used in combination with each other as desired. That one feature may not be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

For example, various characteristics, aspects, and advantages of the present invention may also be embodied in the following technical solutions defined by the following clauses and may include any combination of the following concepts:

A dishwasher comprising: a tub at least partially defining a treating chamber with an open face, a cover movable between an opened and a closed condition to selectively open and close the open face, respectively, with the cover having an inner surface confronting the open face in the closed condition, a treating chemistry dispenser carried by the cover and comprising: a housing defining a cartridge chamber with a drop-in cartridge opening, a lid assembly movable between an opened and closed position to selectively open and close the drop-in cartridge opening, a cartridge motor assembly having pump motor operably coupled to the cartridge chamber and movable relative to the cartridge chamber between an engaged and disengaged positions, and an actuator operably coupling the lid assembly to the cartridge motor assembly such that pump motor is moved from the disengaged to the engaged position upon operation of the actuator.

The dishwasher of any preceding clause wherein the actuator comprises a linkage connecting the lid to the cartridge motor assembly.

The dishwasher of any preceding clause wherein the linkage comprises multiple links which draw the cartridge motor from the disengaged position to the engaged position as the lid is moved from the opened to the closed position.

The dishwasher of any preceding clause wherein the lid is pivotally mounted to the housing for pivotal movement between the opened and closed positions.

The dishwasher of any preceding clause wherein the at least one of the multiple links is pivotally mounted to the lid.

The dishwasher of any preceding clause wherein the at least one of the multiple links is pivotally mounted to the lid above the pivotal mounting of the lid to the housing.

The dishwasher of any preceding clause wherein the cartridge motor assembly comprises a motor frame carrying the pump motor and at least another one of the multiple links is connected to the motor frame.

The dishwasher of any preceding clause wherein the at least another one of the multiple links is pivotally connected to the motor frame.

The dishwasher of any preceding clause wherein the actuator comprises a lock carried by at least one of the lid and housing and moveable between locked and unlocked positions to lock and unlock the lid relative to the housing, respectively.

The dishwasher of any preceding clause wherein the lock comprises a rotatable cam which is rotatable between the unlocked and locked positions.

The dishwasher of any preceding clause wherein the cartridge motor assembly comprises a motor frame carrying the pump motor and the rotatable cam is operably coupled to the motor frame such that rotation of the cam between the unlocked and locked positions moves the pump motor from the disengaged to the engaged position.

The dishwasher of any preceding clause wherein the rotatable cam bears directly against the motor frame.

The dishwasher of any preceding clause wherein the motor frame is biased for movement from the engaged to the disengaged position.

The dishwasher of any preceding clause wherein the cartridge motor assembly comprises a motor frame mounting at least one pump motor.

The dishwasher of any preceding clause wherein the motor frame mounts multiple pump motors.

The dishwasher of any preceding clause wherein the motor frame is biased for movement from the engaged to the disengaged positions.

The dishwasher of any preceding clause further comprising at least one chemistry cartridge dropped into the cartridge chamber through the drop-in opening and having a cartridge pump that couples to the pump motor when the pump motor is in the engaged position.

The dishwasher of any preceding clause wherein the cartridge is a collapsible container.

The dishwasher of any preceding clause wherein the cartridge is a non-collapsible container.

The dishwasher of any preceding clause wherein the drop-in opening defines a plane, which is co-planar with the inner surface.

A treating chemistry dispenser, the treating chemistry dispenser comprising: a housing defining a cartridge chamber with a drop-in cartridge opening, a lid assembly movable between at least an opened and closed position to selectively open and close the drop-in cartridge opening, a cartridge motor assembly having a pump motor operably coupled to the cartridge chamber and movable relative to the cartridge chamber between an engaged position and a disengaged position, and an actuator operably coupling the lid assembly to the cartridge motor assembly such that the pump motor is moved between the disengaged and the engaged positions upon operation of the actuator.

The treating chemistry dispenser of any preceding clause wherein the actuator comprises a linkage connecting the lid assembly to the cartridge motor assembly.

The treating chemistry dispenser of any preceding clause wherein the linkage comprises multiple links which draw the cartridge motor assembly from the disengaged position to the engaged position as the lid assembly is moved from the opened to the closed position.

The treating chemistry dispenser of any preceding clause wherein the lid assembly is pivotally mounted to the housing for pivotal movement between the opened and closed positions.

The treating chemistry dispenser of any preceding clause wherein at least one of the multiple links is pivotally mounted to the lid assembly.

The treating chemistry dispenser of any preceding clause wherein the at least one of the multiple links is pivotally mounted to the lid assembly adjacent the pivotal mounting of the lid assembly to the housing.

The treating chemistry dispenser of any preceding clause wherein the cartridge motor assembly comprises a motor frame carrying the pump motor and another at least one of the multiple links is connected to the motor frame.

The treating chemistry dispenser of any preceding clause wherein the another at least one of the multiple links is pivotally connected to the motor frame.

The treating chemistry dispenser of any preceding clause wherein the actuator is carried by at least one of the lid assembly and the housing and is moveable between locked and unlocked positions to lock and unlock the lid assembly relative to the housing, respectively.

The treating chemistry dispenser of any preceding clause wherein the actuator comprises a rotatable cam which is rotatable between the unlocked and locked positions.

The treating chemistry dispenser of any preceding clause wherein the cartridge motor assembly comprises a motor frame carrying the pump motor and the rotatable cam is operably coupled to the motor frame such that rotation of the rotatable cam between the unlocked and locked positions moves the pump motor between the disengaged and the engaged positions.

The treating chemistry dispenser of any preceding clause wherein the rotatable cam bears directly against the motor frame to move the pump motor to the engaged position when the rotatable cam is in the locked position.

The treating chemistry dispenser of any preceding clause wherein the motor frame comprises a bias biasing the motor frame toward the disengaged position.

The treating chemistry dispenser of any preceding clause wherein the cartridge motor assembly comprises at least one of the pump motor and a motor frame mounting at least one of the pump motors.

The treating chemistry dispenser of any preceding clause wherein the motor frame mounts multiple pump motors.

The treating chemistry dispenser of any preceding clause wherein the motor frame comprises a bias biasing the motor frame toward the disengaged position.

The treating chemistry dispenser of any preceding clause further comprising at least one treating chemistry cartridge inserted into the cartridge chamber through the drop-in cartridge opening and having a cartridge pump that couples to the pump motor when the pump motor is in the engaged position.

The treating chemistry dispenser of any preceding clause wherein the treating chemistry cartridge comprises a collapsible container.

The treating chemistry dispenser of any preceding clause wherein the treating chemistry cartridge comprises a non-collapsible container.

The treating chemistry dispenser of any preceding clause wherein the treating chemistry dispenser is carried by a closure of the dishwasher.

The treating chemistry dispenser of any preceding clause wherein the drop-in cartridge opening defines a plane, which is co-planar with an inner surface of the closure of the dishwasher.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims. Hence, specific dimensions and other physical characteristics relating to the aspects disclosed herein are not to be considered as limiting, unless the claims expressly state otherwise.

What is claimed is:

1. A dishwasher comprising:

a tub at least partially defining a treating chamber with an open face;

a cover movable between an opened condition and a closed condition to selectively open and close the open face, respectively, with the cover having an inner surface confronting the open face in the closed condition; and a treating chemistry dispenser carried by the cover and comprising:

a housing defining a cartridge chamber with a drop-in cartridge opening, a lid assembly movable between an opened position and closed position to selectively open and close the drop-in cartridge opening, a cartridge motor assembly having a pump motor operably coupled to the cartridge chamber and movable relative to the cartridge chamber between an engaged position and a disengaged position, and an actuator operably coupling the lid assembly to the cartridge motor assembly such that the pump motor is moved between the disengaged position and the engaged position upon operation of the actuator wherein the actuator comprises multiple links connecting the lid assembly to the cartridge motor assembly.

2. The dishwasher of claim 1 wherein the multiple links draw the cartridge motor assembly from the disengaged position to the engaged position as the lid assembly is moved from the opened position to the closed position.

3. The dishwasher of claim 2 wherein the lid assembly is pivotally mounted to the housing for pivotal movement between the opened position and the closed position.

4. The dishwasher of claim 3 wherein at least one of the multiple links is pivotally mounted to the lid assembly.

5. The dishwasher of claim 4 wherein the at least one of the multiple links is pivotally mounted to the lid assembly at a location adjacent to where the lid assembly is pivotally mounted to the housing.

6. The dishwasher of claim 5 wherein the cartridge motor assembly comprises a motor frame carrying the pump motor and another at least one of the multiple links is connected to the motor frame.

7. The dishwasher of claim 6 wherein the another at least one of the multiple links is pivotally connected to the motor frame.

8. The dishwasher of claim 1 wherein the actuator is carried by at least one of the lid assembly and the housing and is moveable between a locked position and an unlocked position to lock and unlock the lid assembly relative to the housing, respectively.

9. The dishwasher of claim 8 wherein the actuator comprises a rotatable cam which is rotatable between the unlocked position and the locked position.

10. The dishwasher of claim 9 wherein the cartridge motor assembly comprises a motor frame carrying the pump motor and the rotatable cam is operably coupled to the motor frame such that rotation of the rotatable cam between the unlocked position the locked position moves the pump motor between the disengaged position and the engaged position.

11. The dishwasher of claim 10 wherein the rotatable cam bears directly against the motor frame to move the pump motor to the engaged position when the rotatable cam is in the locked position.

12. The dishwasher of claim 11 wherein the motor frame comprises a bias biasing the motor frame toward the disengaged position.

13. The dishwasher of claim 1 wherein the cartridge motor assembly comprises at least one of the pump motor and a motor frame mounting the at least one of the pump motor.

14. The dishwasher of claim 13 wherein the cartridge motor assembly comprises multiple pump motors and the motor frame mounts the multiple pump motors.

15. The dishwasher of claim 13 wherein the motor frame comprises a bias biasing the motor frame toward the disengaged position.

16. The dishwasher of claim 1 wherein the treating chemistry dispenser further comprises at least one treating chemistry cartridge inserted into the cartridge chamber through the drop-in cartridge opening and having a cartridge pump that couples to the pump motor when the pump motor is in the engaged position.

17. The dishwasher of claim 16 wherein the at least one treating chemistry cartridge comprises a collapsible container.

18. The dishwasher of claim 16 wherein the at least one treating chemistry cartridge comprises a non-collapsible container.

19. The dishwasher of claim 1 wherein the drop-in cartridge opening defines a plane, which is co-planar with the inner surface of the cover.

* * * * *